US011112741B2

(12) United States Patent
Motegi et al.

(10) Patent No.: US 11,112,741 B2
(45) Date of Patent: Sep. 7, 2021

(54) IMAGE FORMING APPARATUS AND NON-TRANSITORY COMPUTER READABLE MEDIUM

(71) Applicant: FUJIFILM Business Innovation Corp., Tokyo (JP)

(72) Inventors: Yuma Motegi, Kanagawa (JP); Daisuke Ishihara, Kanagawa (JP); Yusuke Kaji, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/845,424

(22) Filed: Apr. 10, 2020

(65) Prior Publication Data

US 2021/0191304 A1 Jun. 24, 2021

(30) Foreign Application Priority Data

Dec. 18, 2019 (JP) ..... JP2019-228654

(51) Int. Cl.
*G03G 15/00* (2006.01)

(52) U.S. Cl.
CPC ..... *G03G 15/5025* (2013.01); *G03G 15/5058* (2013.01); *G03G 2215/00054* (2013.01)

(58) Field of Classification Search
CPC ..... G03G 15/5025; G03G 15/5058; G03G 15/5062; G03G 2215/00029; G03G 2215/00033; G03G 2215/00054
See application file for complete search history.

(56) References Cited

U.S. PATENT DOCUMENTS 9,658,564 B1 * 5/2017 Yamasaki ..... G03G 15/043
2011/0292461 A1 * 12/2011 Kubo ..... H04N 1/409 358/448
2015/0248093 A1 9/2015 Ikeda

FOREIGN PATENT DOCUMENTS

JP 2015-161855 A 9/2015

* cited by examiner

*Primary Examiner* — Carla J Therrien
(74) *Attorney, Agent, or Firm* — Sughrue Mion, PLLC

(57) ABSTRACT

An image forming apparatus includes an image forming device, a corrector, and a controller. The image forming device is configured to form an image on a sheet using a rotating body under a predetermined image forming condition. The corrector is configured to correct the image forming condition to adjust image density unevenness corresponding to a rotation cycle of the rotating body. The controller is configured to control the image forming device to form on at least one sheet (i) plural test images that are different in correction amount for the image forming condition and (ii) pointing portions indicating intervals corresponding to the rotation cycle of the rotating body, in a state where the rotating body is continuously rotated.

12 Claims, 6 Drawing Sheets

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2019-228654 filed Dec. 18, 2019.

BACKGROUND

1. Technical Field

The present disclosure relates to an image forming apparatus and a non-transitory computer readable medium.

2. Related Art

As a related art, JP-A-2015-161855 discloses an image forming apparatus that detects a density of a measurement pattern formed on a recording medium by a density detector, and corrects, based on the detection results, density unevenness derived from a periodic member that operates periodically. The image forming apparatus includes a phase detector that detects a phase of the periodic member. The image forming apparatus forms a reference mark corresponding to the cycle of the periodic member on a recording medium based on the detection results by the phase detector, together with the measurement pattern.

SUMMARY

An image forming condition may be corrected in order to reduce image density unevenness corresponding to the rotation cycle of a rotating body such as a developing roller. For example, plural test images that are different in correction amount for an image forming condition are formed on sheets, and an appropriate correction amount is determined based on the test images. When a user determines, based on the test images formed on the sheets, whether correction is insufficient and whether the correction is excessive, an image indicating the rotation cycle of the rotating body may be formed on the sheets in addition to the test images in order for the user to easily make the determination. However, when a unit that detects the rotation cycle is provided in the rotating body, for example, the space occupied by the rotating body increases or the cost increases.

Aspects of non-limiting embodiments of the present disclosure relate to making it possible to obtain the rotation cycle of a rotating body from test images formed on a sheet(s) even if no detector for detecting the cycle of the rotating body is provided in the rotating body itself.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image forming device configured to form an image on a sheet using a rotating body under a predetermined image forming condition, a corrector configured to correct the image forming condition to adjust image density unevenness corresponding to a rotation cycle of the rotating body, and a controller configured to control the image forming device to form on at least one sheet (i) a plurality of test images that are different in correction amount for the image forming condition and (ii) pointing portions indicating intervals corresponding to the rotation cycle of the rotating body, in a state where the rotating body is continuously rotated.

BRIEF DESCRIPTION OF THE DRAWINGS

Exemplary embodiment(s) of the present disclosure will be described in detail based on the following figures, wherein.

DETAILED DESCRIPTION

Exemplary embodiments of the present disclosure will be described below with reference to the accompanying drawings.

Figure 1:
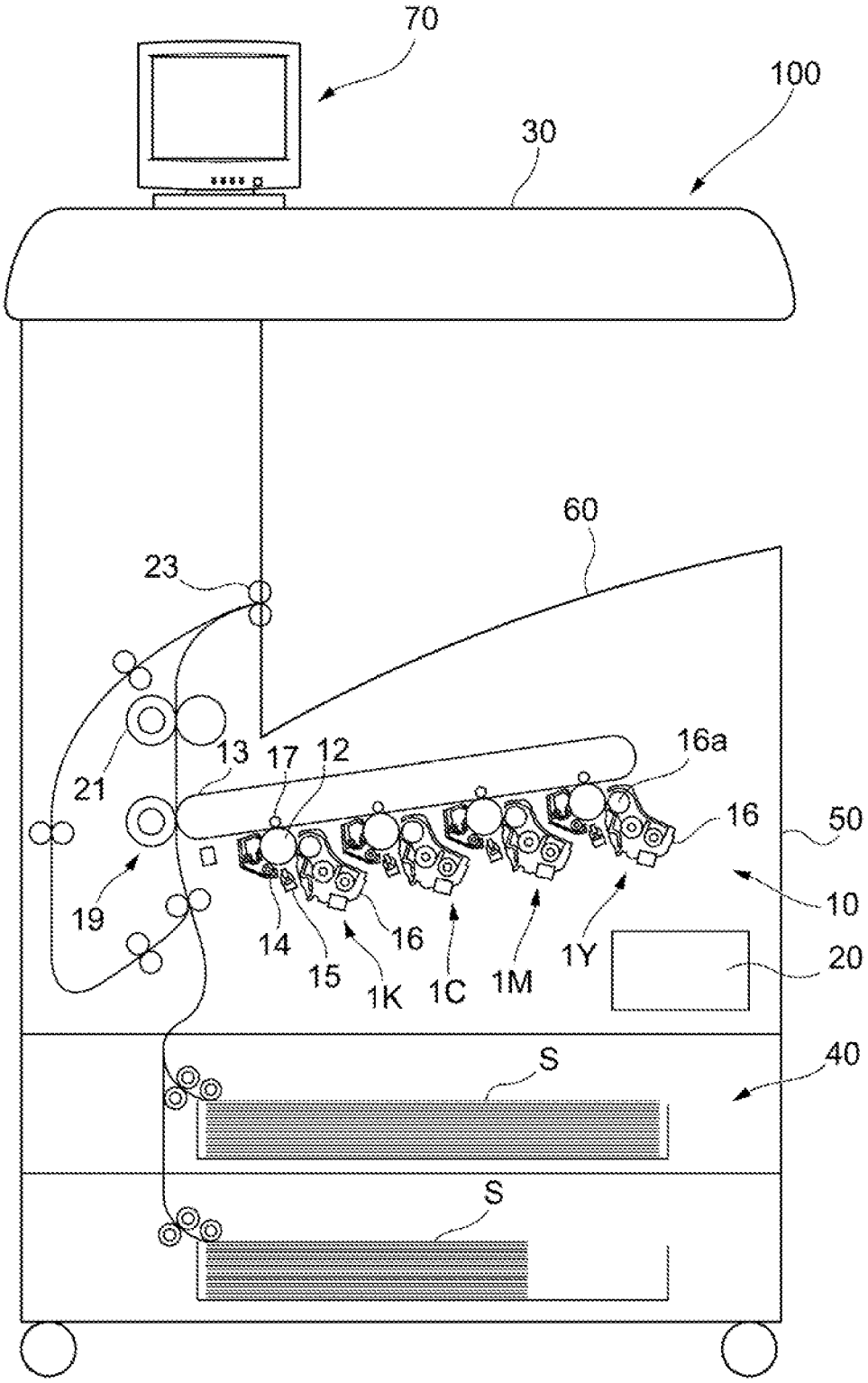
FIG. 1 is a schematic configuration diagram illustrating an image forming apparatus according to an exemplary embodiment.

FIG. 1 is a schematic configuration diagram illustrating an image forming apparatus 100 according to an exemplary embodiment. The image forming apparatus 100 illustrated in FIG. 1 is a so-called tandem color printer. The image forming apparatus 100 includes an image forming device 10, a control device 20, an image reader 30, and a sheet feeder 40. The image forming device 10 forms an image based on image data of colors. The control device 20 controls operation of the overall image forming apparatus 100. The image reader 30 reads an image of a document. The sheet feeder 40 feeds sheets S to the image forming device 10.

Here, components of the image forming apparatus 100 are accommodated in a casing 50. A stacking unit 60 is provided below the image reader 30 and on the upper surface of the casing 50. The sheet S on which the image is formed by the image forming device 10 is stacked on the stacking unit 60. An operation unit 70 is provided above the image reader 30. The operation unit 70 receives a user's operation with respect to the image forming apparatus 100.

The image forming device 10 includes four image forming units 1Y, 1M, 1C, and 1K arranged in parallel at regular intervals. The image forming units 1Y, 1M, 1C, and 1K form toner images by a so-called electrophotographic process. Here, the image forming units 1Y, 1M, 1C, and 1K are similarly configured to each other, except for toners accommodated in developing devices 16 which will be described later. The image forming units 1Y, 1M, 1C, and 1K form toner images of yellow (Y), magenta (M), cyan (C), and black (K), respectively. Therefore, in the following description, when the configurations of the image forming units 1Y, 1M, 1C, and 1K do not need to be distinguished from each other, reference signs of "Y", "M", "C", and "K" will be omitted.

The image forming device 10 includes an intermediate transfer belt 13 to which toner images of the respective colors formed on photoconductor drums 12 of the image forming units 1 are transferred. The image forming device 10 includes primary transfer rollers 17 that sequentially transfer (primarily transfer) the toner images of the respective colors formed by the image forming units 1 to the intermediate transfer belt 13. The image forming device 10 includes a secondary transfer roller 19, a fixing device 21, and discharge rollers 23. The secondary transfer roller 19 collectively transfers (secondarily transfers) the toner images of the colors, which are formed on the intermediate transfer belt 13 in a superimposed manner, to a sheet S. The fixing device 21 fixes the secondarily transferred toner images of the colors onto the sheet S. The discharge rollers 23 discharge the sheet S. The image forming device 10 includes a power supply 25 (see FIG. 3) that supplies power to a developing roller 16*a* (which will be described later) of the developing device 16 of each image forming unit 1.

Each image forming unit 1 includes the photoconductor drum 12, a charging device 14, an exposure device 15, and a developing device 16. The photoconductor drum 12 carries a toner image. The charging device 14 charges the photoconductor drum 12. The exposure device 15 forms an electrostatic latent image by exposure of the surface of the charged photoconductor drum 12. The developing device 16 develops the electrostatic latent image formed on the photoconductor drum 12 to form the toner image.

The developing device 16 includes the rotatable developing roller 16*a* that faces the outer peripheral surface of the photoconductor drum 12 via a predetermined distance. The developing roller 16*a* is as an example of a rotatable developing body. Each developing device 16 accommodates a developer containing a toner of a corresponding color (for example, yellow toner in the yellow image forming unit 1Y) therein. Magnets are built in the developing roller 16*a*. The developing roller 16*a* carries the developer containing the toner on the surface thereof by a magnetic force. In the developing device 16, a predetermined developing bias voltage is applied to the developing roller 16*a* by the power supply 25. As will be described in detail later, in the present exemplary embodiment, the power supply 25 applies the developing bias voltage in which a DC voltage and an AC voltage are superimposed, to the developing roller 16*a* under the control of the control device 20. Thereby, the toner carried on the surface of the developing roller 16*a* is transferred from the surface of the developing roller 16*a* to an image portion of the electrostatic latent image formed on the photoconductor drum 12.

The image forming apparatus 100 executes a series of image forming processing under control of the control device 20. That is, an image processor (not illustrated) performs image processing on image data acquired from a PC (not illustrated) or the image reader 30 to obtain image data of the colors, and sends the image data of each color to the exposure device 15 of the corresponding image forming unit 1. Then, the exposure device 15 performs the exposure and the developing device 16 performs the development, so that the toner image is formed on the photoconductor drum 12.

The toner images of the respective colors formed on the photoconductor drums 12 of the respective image forming units 1 are primarily transferred onto the intermediate transfer belt 13 by the respective primary transfer rollers 17 in sequence. As a result, a superimposed toner image in which the toners of the colors are superimposed is formed on the intermediate transfer belt 13. The superimposed toner image is transported toward the secondary transfer roller 19 with traveling of the intermediate transfer belt 13.

The sheet S fed from the sheet feeder 40 is transported to the secondary transfer roller 19 in accordance with a transportation timing of the superimposed toner image on the intermediate transfer belt 13. Then, the superimposed toner image on the intermediate transfer belt 13 is secondarily transferred onto the sheet S by the secondary transfer roller 19. The superimposed toner image transferred to the sheet S is fixed onto the sheet S by the fixing device 21, and then discharged to the stacking unit 60 by the discharge rollers 23.

In the image forming apparatus 100, the distance between the developing roller 16*a* and the photoconductor drum 12 may vary due to eccentricity of the developing roller 16*a* of the image forming unit 1 or unevenness of the outer peripheral surface of the developing roller 16*a* of the image forming unit 1. In this case, when an electric field between the developing roller 16*a* and the photoconductor drum 12 changes, density unevenness corresponding to the rotation cycle of the developing roller 16*a* may occur in the image formed by the image forming device 10 on the sheet S. Here, in one cycle, the developing roller 16*a* rotates once. The "density unevenness corresponding to the rotation cycle of the developing roller 16*a*" is a variation in image density that occurs in a sub-scanning direction of the sheet S when an image is formed on the sheet S at a uniform image density.

The image forming apparatus 100 of the present exemplary embodiment corrects an image forming condition in order to reduce such density unevenness corresponding to the rotation cycle of the developing roller 16*a*. More specifically, the image forming apparatus 100 of the present exemplary embodiment detects an alternating current flowing between the developing roller 16*a* and the photoconductor drum 12 in response to the power supply 25 applying the developing bias voltage. Then, the image forming apparatus 100 corrects, based on the detection results, the DC voltage of the developing bias voltage to be applied to the developing roller 16*a* by the power supply 25. The DC voltage is an example of the image forming condition.

Figure 2:
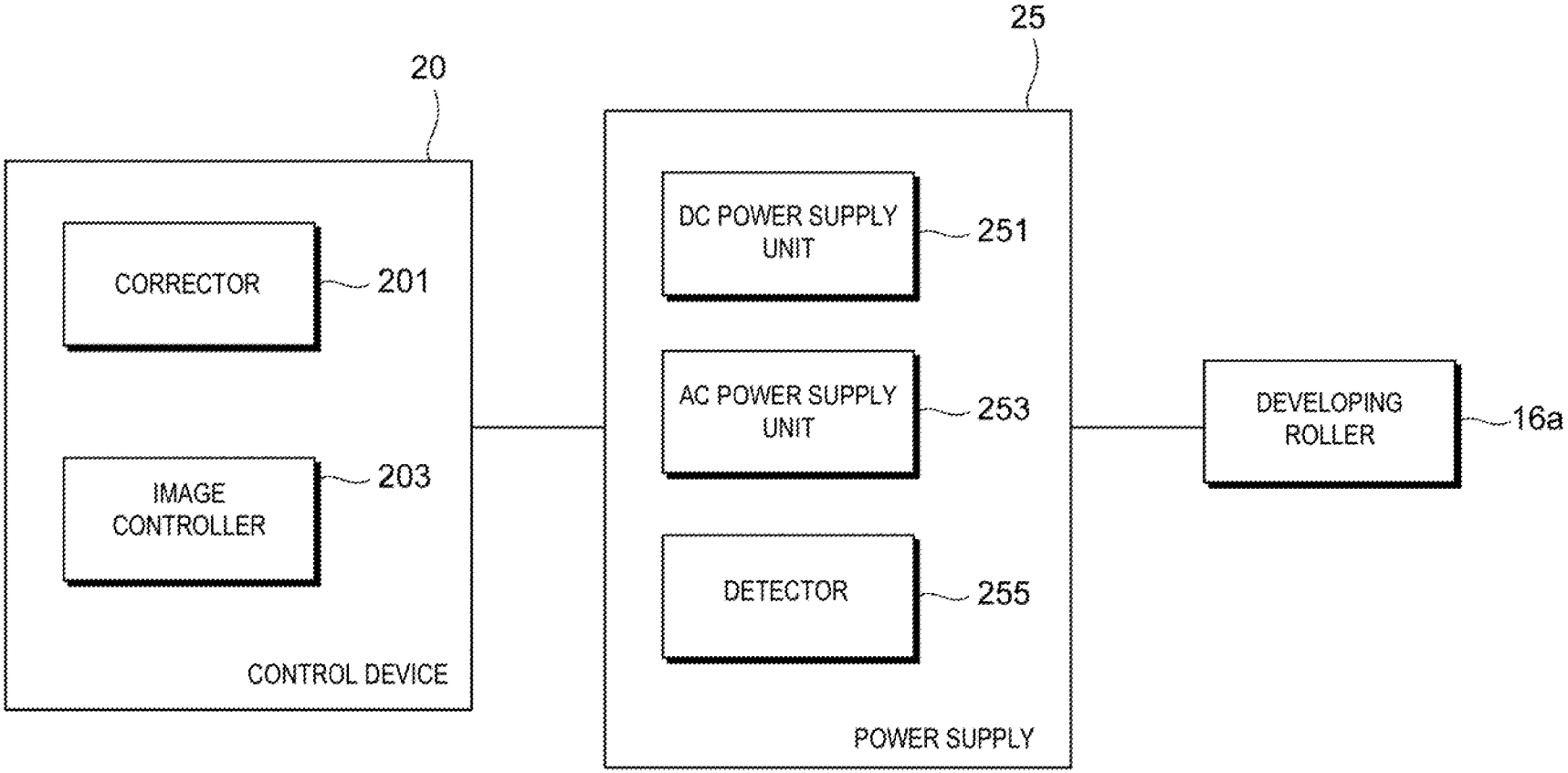
FIG. 2 is a block diagram illustrating an electrical configuration of the image forming apparatus according to the present exemplary embodiment and a functional configuration of a control device according to the present exemplary embodiment.

FIG. 2 is a block diagram illustrating an electric configuration of the image forming apparatus 100 according to the present exemplary embodiment and a functional configuration of the control device 20 according to the present exemplary embodiment.

As illustrated in FIG. 2, the power supply 25 of the present exemplary embodiment includes a DC power supply unit 251 and an AC power supply unit 253. The DC power supply unit 251 applies the DC voltage to the developing roller 16*a*. The AC power supply 253 applies the AC voltage to the developing roller 16*a*. The power supply 25 includes a detector 255 that detects an alternating current flowing between the developing roller 16*a* and the photoconductor drum 12.

The control device 20 includes a central processing unit (CPU), a read only memory (ROM), and a random access memory (RAM). The ROM stores a control program to be executed by the CPU. The CPU reads out the control program stored in the ROM, and executes the control program using the RAM as a work area. The CPU executes the control program to control the elements of the image forming apparatus 100.

As illustrated in FIG. 2, the control device 20 of the present exemplary embodiment includes a corrector 201 that determines a correction amount for the DC voltage (an example of the image forming condition) to be applied to the developing roller 16*a* by the DC power supply unit 251. The control device 20 includes an image controller 203. The image controller 203 controls the image forming device 10 including the power supply 25 to form test images used to check density unevenness corresponding to the rotation cycle of the developing roller 16*a* on a sheet S, using the correction amounts determined by the corrector 201. The image controller 203 is an example of a controller. A process of forming the test image under the control of the image controller 203 will be described later.

The corrector 201 determines the correction amount for the DC voltage to be applied to the developing roller 16*a* by the DC power supply unit 251, based on the detection results by the detector 255 of the power supply 25. More specifically, when plural test images are formed on a sheet(s) S in order to determine an appropriate correction amount for the DC voltage, the corrector 201 determines plural correction amounts to be applied to the respective test images. Here, it may be clear whether at least one correction amount among the plural correction amounts determined by the corrector 201 is smaller than the appropriate correction amount or larger than the appropriate correction amount. The corrector 201 may set the magnitude of a correction amount to 0 (no correction) as the correction amount smaller than the appropriate correction amount.

The image controller 203 controls the image forming device 10 to form the plural test images on the sheet S with toners of predetermined colors using the plural correction amounts determined by the corrector 201. In addition, the image controller 203 controls the DC power supply unit 251 of the power supply 25 so as to cancel the density unevenness corresponding to the rotation cycle of the developing roller 16*a*.

In the image forming apparatus 100, when the distance between the developing roller 16*a* and the photoconductor drum 12 that is a cause of the density unevenness corresponding to the rotation cycle of the developing roller 16*a* varies, the magnitude of the alternating current flowing between the developing roller 16*a* and the photoconductor drum 12 varies in response to the power supply 25 applying the developing bias voltage. When the distance between the developing roller 16*a* and the photoconductor drum 12 decreases, the alternating current flowing between the developing roller 16*a* and the photoconductor drum 12 increases. On the other hand, when the distance between the developing roller 16*a* and the photoconductor drum 12 increases, the alternating current flowing between the developing roller 16*a* and the photoconductor drum 12 decreases.

The corrector 201 of the present exemplary embodiment determines the correction amount for the DC voltage to be applied to the developing roller 16*a* by the DC power supply unit 251 based on the alternating current, which flows between the developing roller 16*a* and the photoconductor drum 12 and is detected by the detector 255 of the power supply 25. More specifically, when the alternating current flowing between the developing roller 16*a* and the photoconductor drum 12 is larger than a predetermined reference value, the corrector 201 determines the correction amount for the DC voltage so as to decrease the DC voltage to be applied to the developing roller 16*a* by the DC power supply unit 251. On the other hand, when the alternating current flowing between the developing roller 16*a* and the photoconductor drum 12 is smaller than the predetermined reference value, the corrector 201 determines the correction amount for the DC voltage so as to increase the DC voltage to be applied to the developing roller 16*a* by the DC power supply unit 251. In the present exemplary embodiment, the correction amount for the DC voltage is the absolute value of a difference between a DC voltage before correction and a corrected DC voltage.

However, even when the correction is made based on the detection results by the alternating current flowing between the developing roller 16*a* and the photoconductor drum 12, the density unevenness corresponding to the rotation cycle of the developing roller 16*a* may not be reduced due to, for example, an environment around the image forming apparatus 100. The correction amount determined by the corrector 201 may be insufficient to correct the DC voltage, or conversely, may be excessive to correct the DC voltage. Therefore, in the image forming apparatus 100, the test images are formed on the sheet S using the plural correction amounts determined by the corrector 201 under the control of the image controller 203. Then, a user visually checks the plural test images, which are different in correction amount and are formed on the sheet S, to determine the appropriate correction amount.

The test images are not particularly limited to specific ones, but may be any test images that enable the user to check density unevenness corresponding to the rotation cycle of the developing roller 16*a*. Examples of the test images include rectangular or strip-shaped images each having a length, in the sub-scanning direction, equal to or larger than a length corresponding to the rotation cycle of the developing roller 16*a*.

Figure 3:
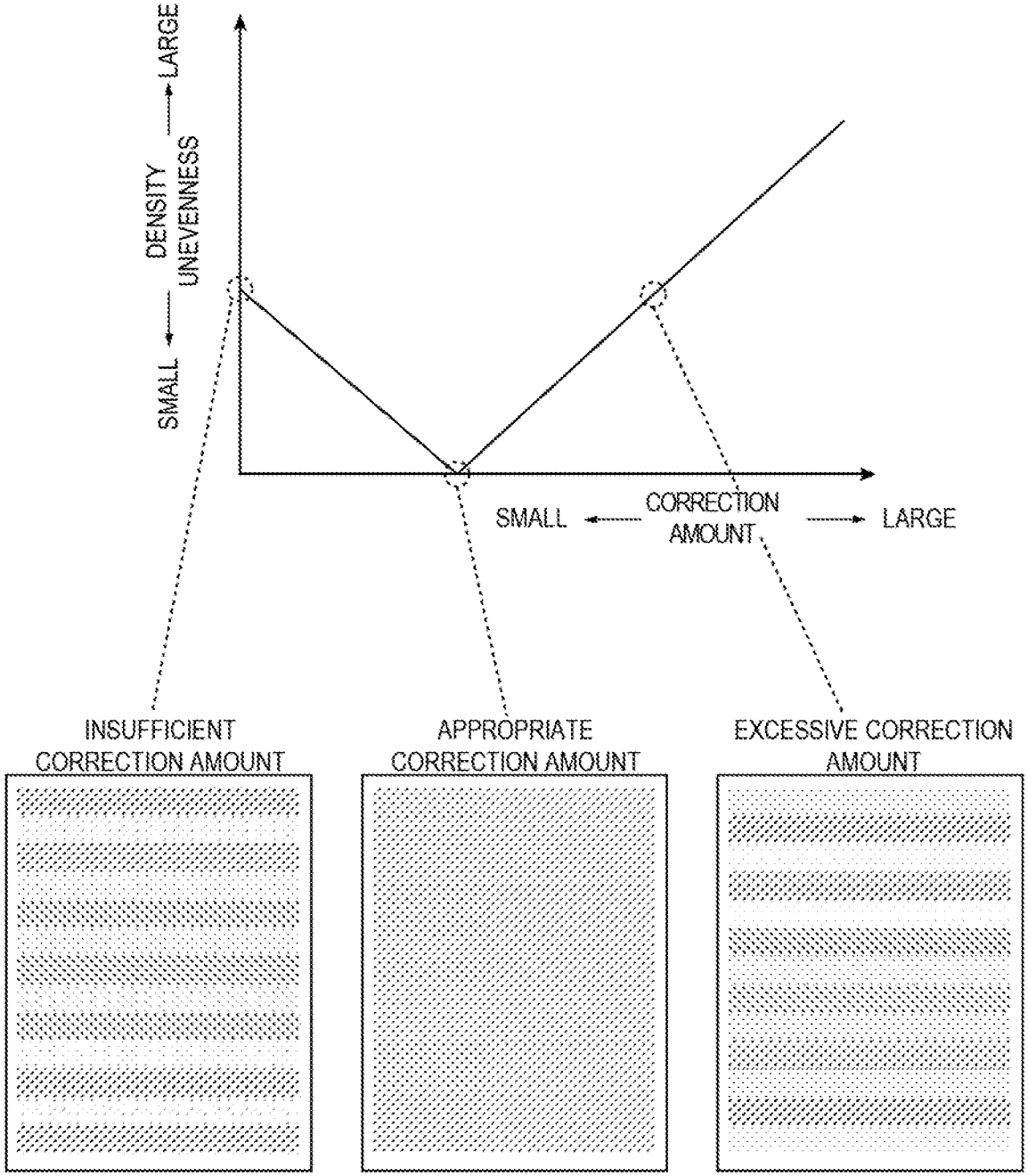
FIG. 3 is a schematic view illustrating the relationship between the magnitude of a correction amount of a DC voltage and density unevenness corresponding to the rotation cycle of a developing roller that appears in a test image.

FIG. 3 is a schematic diagram illustrating the relationship between the magnitude of the correction amount for the DC voltage and the density unevenness corresponding to the rotation cycle of the developing roller 16*a* that appears in the test image.

As illustrated in FIG. 3, in the test image, a high density portion (a portion having a dark color) and a low density portion (a portion having a pale color) alternately appear in the sub-scanning direction in accordance with the rotation cycle of the developing roller 16*a*. The density difference between the high density portion and the low density portion corresponds to the image density unevenness corresponding to the rotation cycle of the developing roller 16*a*. The smaller the density difference between the high density portion and the low density portion is, the more appropriate the correction amount for the DC voltage is. In the following description, a correction amount that generate no density difference in a test image may be referred to as an "appropriate correction amount".

Here, as illustrated in FIG. 3, phases of a high density portion and a low density portion that appear in accordance with the rotation cycle of the developing roller 16*a* in a case where a correction amount for the DC voltage is smaller than an appropriate correction amount (that is, in a case where the correction amount is insufficient for the appropriate correction amount) are opposite to those in a case where the correction amount for the DC voltage is larger than the appropriate correction amount (that is, in a case where the correction amount is excessive for the appropriate correction amount). However, when a user looks at a test image that is insufficient in correction amount and a test image that is excessive in correction amount individually, it is difficult for him or her to check the phases of a high density portion and a low density portion so as to determine (i) whether the correction amount is insufficient for the appropriate correction amount and (ii) whether the correction amount is excessive for the appropriate correction amount.

In contrast, in the present exemplary embodiment, the image controller 203 forms periodic images indicating intervals corresponding to the rotation cycle of the developing roller 16*a* on the sheet S in addition to the test images. The periodic images are an example of pointing portions. With this configuration, for the plural test images formed on the sheet S, the user can easily determine whether the phases of the high density portion and the low density portion that appear in accordance with the rotation cycle of the developing roller 16*a* are equal to or opposite to each other.

In the following description, phases of a high density portion and a low density portion that appear in a test image in accordance with the rotation cycle of the developing roller 16*a* may be referred to as a "phase of density unevenness".

Figure 4:
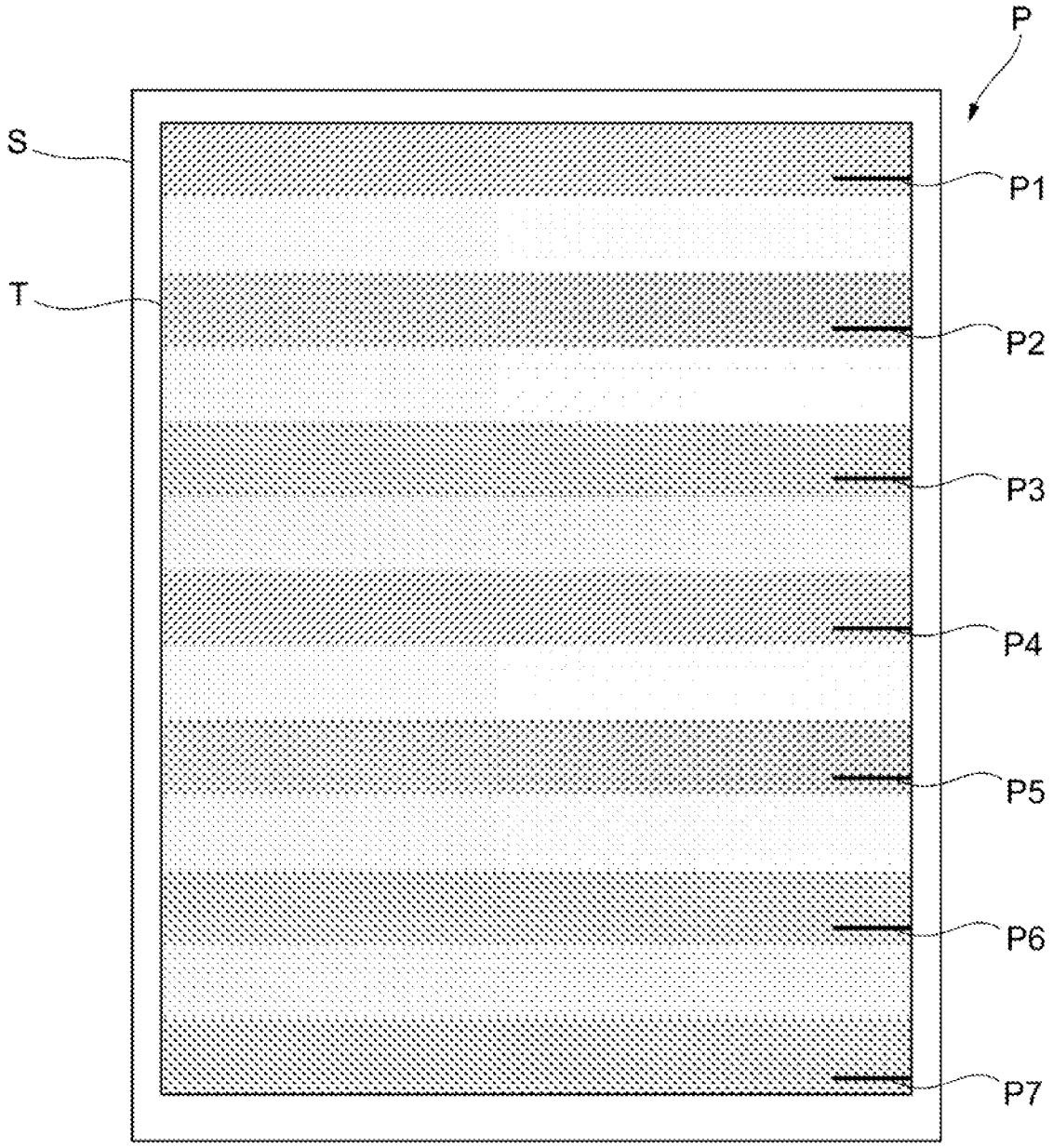
FIG. 4 is a diagram illustrating an example of a test image and periodic images formed on a sheet by an image controller.

FIG. 4 is a diagram illustrating an example of a test image T and periodic images P that are formed on the sheet S by the image controller 203. FIG. 4 illustrates one test image T among the plural test images which are different in correction amount and which are formed under the control of the image controller 203.

As described above, the image controller 203 controls the image forming device 10 to form (i) the test image T to which the correction amount determined by the corrector 201 is applied and (ii) the periodic images P indicating the intervals corresponding to the rotation cycle of the developing roller 16*a* in the test image T, on the sheet S.

The image controller 203 of the present exemplary embodiment obtains the rotation cycle of the developing roller 16*a* based on the alternating current, which flows between the developing roller 16*a* and the photoconductor drum 12 and which is detected by the detector 255 of the power supply 25. As described above, the developing roller 16*a* rotates once in one cycle, and the magnitude of the alternating current flowing between the developing roller 16*a* and the photoconductor drum 12 varies periodically. The image controller 203 obtains the intervals corresponding to the rotation cycle of the developing roller 16*a* in the sub-scanning direction of the sheet S based on the periodic variation of the magnitude of the alternating current.

Then, the image controller 203 forms the periodic images P including plural marks P1, P2, . . . on the sheet S together with the test image T. The marks P1, P2, . . . are arranged in the sub-scanning direction at intervals corresponding to the rotation cycle of the developing roller 16*a*. In this example, each of the marks P1, P2, . . . constituting the periodic images P are linear images extending along the main scanning direction.

Here, in the periodic images P formed on the sheet S, an interval between any two of the marks P1, P2, . . . constituting the periodic images P is an integral multiple of the rotation cycle of the developing roller 16*a*. For example, the interval between two adjacent marks P1 and P2 of the periodic images P corresponds to a length in the sub-scanning direction of an image that is formed during one rotation of the developing roller 16*a*.

The image controller 203 of the present exemplary embodiment continuously performs the image forming operation by the image forming device 10, so as to form the plural test images T and the periodic images P on the sheet S in a state where the developing roller 16*a* and the photoconductor drum 12 are continuously rotated without being stopped.

As described above, the periodic variation of the alternating current, which flows between the developing roller 16*a* and the photoconductor drum 12 and which is detected by the detector 255, is based on a relative distance between the developing roller 16*a* and the photoconductor drum 12. That is, the periodic variation of the alternating current detected by the detector 255 corresponds to the rotation cycle of the developing roller 16*a*, but does not correspond to a specific phase in the developing roller 16*a*. Therefore, the relationship between the rotation phase of the developing roller 16*a* and the periodic images P formed on the sheet S by the image controller 203 is constant during a period in which the image forming operation by the image forming device 10 is continuously performed, that is, during a period in which the developing roller 16*a* and the photoconductor drum 12 are continuously rotated without being stopped. On the other hand, in a case where the image forming operation by the image forming device 10 is stopped, even if the image forming operation is resumed, the relationship between the rotational phase of the developing roller 16*a* and the periodic images P formed on the sheet S by the image controller 203 is not necessarily constant.

In the present exemplary embodiment, the plural test images T and the periodic image P are formed on the sheet S in the state where the developing roller 16*a* and the photoconductor drum 12 are continuously rotated without being stopped, so that the plural test images T are equal to each other in relationship between the rotational phase of the developing roller 16*a* and the periodic images P. Thus, with regard to the plural test images T, a user can check a relationship between the correction amount applied to each test image T and the appropriate correction amount by comparing, for example, phases of density unevenness at positions at which the periodic images P (marks P1, P2, . . . ) are formed (that is, whether each position corresponds to a high density portion or a low density portion).

Figure 5:
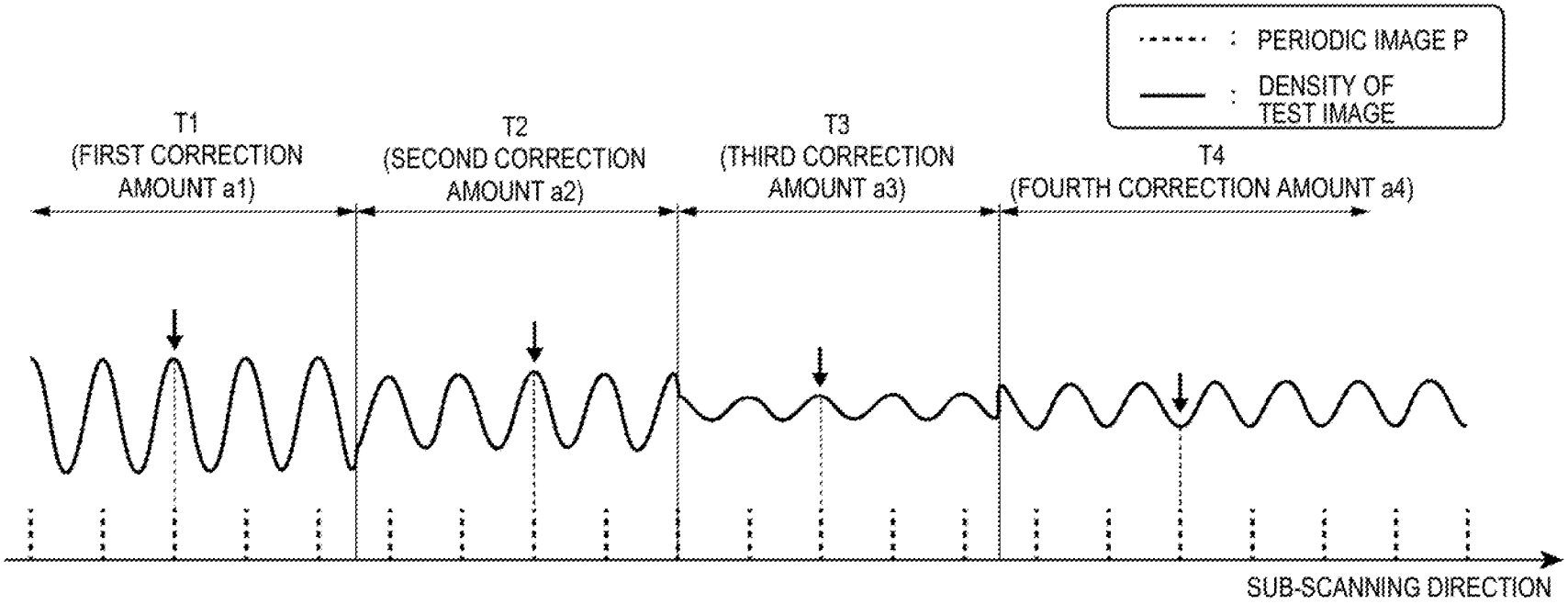
FIG. 5 is a diagram illustrating the relationship among a correction amount, an image density, and periodic images in each of plural test images when the plural test images and the periodic images are formed on a sheet in a state where the developing roller and a photoconductor drum are continuously rotated.

FIG. 5 is a diagram illustrating a relationship among the correction amount, the image density, and the periodic images P in each of plural test images T when the plural test images T and the periodic images P are formed on a sheet S in a state where the developing roller 16*a* and the photoconductor drum 12 are continuously rotated. Here, a case where four test images that are different in correction amount are formed on the sheet S will be described as an example. More specifically, description will be given on a case where a first test image T1 to which a first correction amount a1 is applied, a second test image T2 to which a second correction amount a2 is applied, a third test image T3 to which a third correction amount a3 is applied, and a fourth test image T4 to which a fourth correction amount a4 is applied are continuously formed on the sheet S, as an example. In this example, the magnitude of the first correction amount a1 is 0 (no correction). The magnitude relationship among the first correction amount a1 to the fourth correction amount a4 is represented by $a1<a2<a3<a4$.

When an appropriate correction amount is estimated based on the first test image T1 to the fourth test image T4 illustrated in FIG. 5, a user checks for each test image the phases of the image density unevenness at positions where the periodic images P are formed (that is, whether each position corresponds to a high density portion or a low density portion). In this example, in the first test image T1 to the third test image T3, the positions where the periodic images P are formed correspond to the high density portions where the image density is high, and the phases of the density unevenness are equal to each other. On the other hand, in the fourth test image T4, the image density is low at the positions where the periodic images P are formed, and the phases of the density unevenness are different from those in the first test image T1 to the third test image T3.

Therefore, in the example illustrated in FIG. 5, it can be estimated that the first correction amount a1 to the third correction amount a3 are smaller than the appropriate correction amount and that the fourth correction amount a4 is larger than the appropriate correction amount. In other words, it can be estimated that the appropriate correction amount exists between the third correction amount a3 and the fourth correction amount a4.

In the present exemplary embodiment, as illustrated in FIG. 5, the periodic images P are formed such that at least one of the marks P1, P2 . . . of the periodic images P is formed in each of the test images (the first test image T1 to the fourth test image T4), which are different in correction amount. This prevents a test image having no periodic image P from existing, and enables the user to check phases of density unevenness using the periodic images P, for all test images.

The plural test images T which are different in correction amount may be formed on one common sheet S, or may be formed on plural sheets S different from each other. In the present exemplary embodiment, the plural test images T which are different in correction amount may be formed on plural sheets S different from each other. When the plural test images T are formed on the plural sheets S different from each other, for example, a user can compare the densities of the test images with the sheets S overlapped with each other.

As a configuration for obtaining the rotation cycle of the developing roller 16*a* for the purpose of forming the periodic images P, for example, a detection device that detects the rotation phase of the developing roller 16*a* may be provided so as to directly detect the rotation phase of the developing roller 16*a*. However, this configuration may require to provide the detection device that detects the rotation phase of the developing device 16 in the developing device 16 in order to form the periodic images P. In this case, the detection device needs to be manufactured, and a space is required in which the detection device is provided. A structural design of the detection device and an electrical design of the detection device (including input and output of the detection device) are also required, which results in an increase in manufacturing cost and spatial restriction. In contrast, in the present exemplary embodiment, the detector 255 of the power supply 25 detects the rotation phase of the developing roller 16*a* without a detection device being provided in the developing roller 16*a*.

Figure 6:
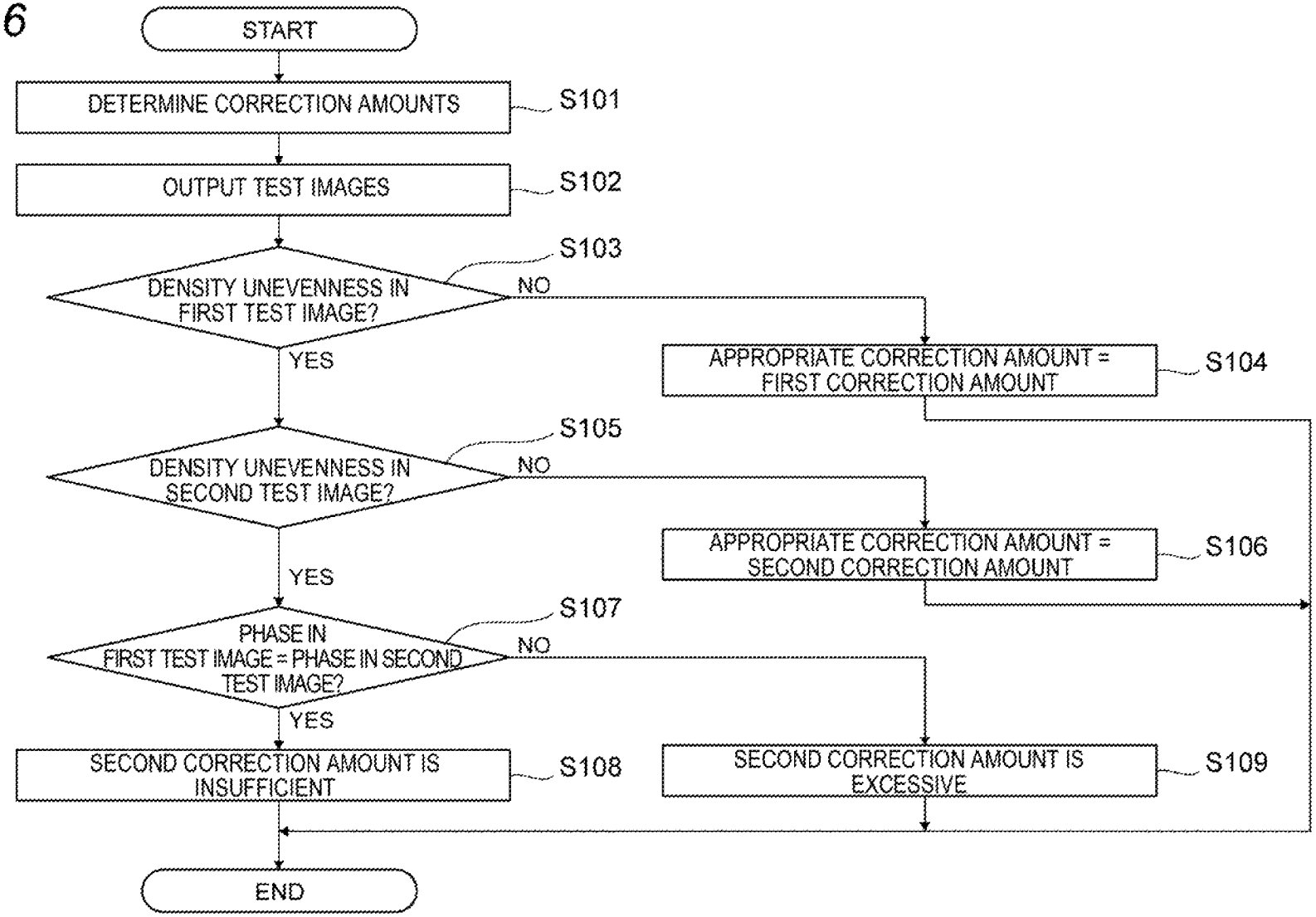
FIG. 6 is a flowchart illustrating an example of a procedure for checking an appropriate correction amount for an image forming condition based on the test images.

Next, an example of a procedure for forming test images on a sheet S in the image forming apparatus 100 of the present exemplary embodiment and checking an appropriate correction amount for an image forming condition based on the test images will be described. FIG. 6 is a flowchart illustrating the example of the procedure for checking the appropriate correction amount for the image forming condition based on the test images. Here, a case where the first test image T1 in which the correction amount is the first correction amount a1 and the second test image T2 in which the correction amount is the second correction amount a2 are formed on the sheet S as plural test images will be described as an example.

When checking the appropriate correction amount for the image forming condition, the user instructs the image forming apparatus 100, for example, via the operation unit 70 to output test images. When the user instructs the image forming apparatus 100 to output the test images, the corrector 201 of the control device 20 determines correction amounts to be applied to the test images based on detection results of an alternating current detected by the detector 255 of the power supply 25 (step 101). In this example, the corrector 201 determines the first correction amount a1 (=0) to be applied to the first test image T1 and the second correction amount a2 (>a1) to be applied to the second test image T2.

Next, the image forming apparatus 100 forms plural test images that are different in correction amount on sheets S in a state where the image forming operation by the image forming device 10 are continued under control of the image controller 203 and outputs the test images (step 102). In this example, the image forming apparatus 100 forms the first test image T1 to which the first correction amount a1 (=0) is applied on one sheet S and forms the second test image T2 to which the second correction amount a2 (>first correction amount a1) is applied on another sheet S.

Next, the user visually checks the first test image T1 formed on the one sheet S, and determines whether density unevenness occurs in the first test image T1 (step 103).

When the user determines that no density unevenness occurs in the first test image T1 (NO in step 103), the user inputs to the image forming apparatus 100 via the operation unit 70 that no density unevenness occurs in the first test image T1. Then, the corrector 201 of the control device 20 determines that the first correction amount a1 is the appropriate correction amount (step 104).

On the other hand, when the user determines that the density unevenness occurs in the first test image T1 (YES in step 103), the user visually checks the second test image T2 formed on the other sheet S, and determines whether density unevenness occurs in the second test image T2 (step 105).

When the user determines that no density unevenness occurs in the second test image T2 (NO in step 105), the user inputs to the image forming apparatus 100 via the operation unit 70 that no density unevenness occurs in the second test image T2. Then, the corrector 201 of the control device 20 determines that the second correction amount a2 is the appropriate correction amount (step 106).

On the other hand, when the user determines that the density unevenness occurs in the second test image T2 (YES in step 105), the user visually checks the relationship between the phase of the density unevenness of the first test image T1 and the phase of the density unevenness of the second test image T2. That is, the user determines whether the phase of the density unevenness of the first test image T1 is equal to that of the second test image T2 (step 107).

When the user determines that the phase of the density unevenness of the first test image T1 is equal to that of the second test image T2 (YES in step 107), the user inputs to the image forming apparatus 100 via the operation unit 70 that the phase of the density unevenness of the first test image T1 is equal to that of the second test image T2.

As described above, when the phase of the density unevenness of the first test image T1 is equal to that of the second test image T2, both the first correction amount a1 and the second correction amount a2 are smaller than the appropriate correction amount. Therefore, the corrector 201 of the control device 20 determines that the second correction amount a2 is insufficient (step 108), and ends the series of processes. In this case, the corrector 201 may newly set a first correction amount a1' and a second correction amount a2' that are larger than the second correction amount a2, and return to the step 102 to continue the processing using the first correction amount a1' and the second correction amount a2'.

On the other hand, when the user determines that the phase of the density unevenness of the first test image T1 is different from that of the second test image T2 (NO in step 107), the user inputs to the image forming apparatus 100 via the operation unit 70 that the phase of the density unevenness of the first test image T1 is different from that of the second test image T2.

As described above, when the phase of the density unevenness of the first test image T1 is different from that of the second test image T2, the first correction amount a1 is smaller than the appropriate correction amount, and the second correction amount a2 is larger than the appropriate correction amount. Therefore, the corrector 201 of the control device 20 determines that the second correction amount a2 is excessive (step 109), and ends the series of processes. In this case, the corrector 201 may newly set a second correction amount a2" smaller than the second correction amount a2, and return to step 102 to continue the processing using the first correction amount a1 and the second correction amount a2".

As described above, in the image forming apparatus 100 of the present exemplary embodiment, the periodic images P indicating the intervals corresponding to the rotation cycle of the developing roller 16*a* on the sheet S, so that it is possible for the user to know the rotation cycle of the developing roller 16*a* in the test image formed on the sheet S. The rotation cycle of the developing roller 16*a* is obtained based on the magnitude of the alternating current detected by the detector 255 of the power supply 25, so that there is no need to provide a detection device that detects the rotation cycle of the developing roller 16*a*.

In the present exemplary embodiment, the corrector 201 corrects the DC voltage to be applied to the developing roller 16*a* as an image forming condition. The present disclosure is not limited thereto. The image forming condition corrected by the corrector 201 is not limited to specific one, but may be any image forming condition that makes it possible to adjust image density unevenness corresponding to the rotation cycle of a rotating body, such as the magnitude of a DC voltage to be applied to the developing roller 16*a*, an exposure amount by the exposure device 15, and the magnitude of a charging bias of the charging device 14.

In the present exemplary embodiment, the rotation cycle of the developing roller 16*a* (an example of the rotating body) is obtained based on the alternating current detected by the detector 255, and the periodic images P are formed on the sheet S. The present disclosure is not limited thereto. That is, the rotating body is not limited to the developing roller 16*a* but may be any rotating body that makes it possible for the image controller 203 to acquire a signal corresponding to the surface shape of the rotating body and obtain the rotation cycle of the rotating body based on the acquired signal. For example, the rotation cycle of the photoconductor drum 12 may be obtained based on the alternating current detected by the detector 255, and the image forming condition may be corrected based on the obtained rotation cycle and the periodic images P may be formed based on the detected obtained rotation cycle.

In the present exemplary embodiment, the linear images extending in the main scanning direction are exemplified as an example of the marks P1, P2, . . . constituting the periodic images P. The marks P1, P2, . . . constituting the periodic images P are not limited to the linear images, but may be any images that indicate intervals corresponding to the rotation cycle of a rotating body. For example, the test images may be partially removed at intervals corresponding to the rotation cycle of the rotating body so as to indicate the intervals corresponding to the rotation cycle of the rotating body.

In addition, the present disclosure is not limited to the above-described exemplary embodiment. For example, the present disclosure may be applied to an intermediate transfer body of an inkjet printer. Various modifications and combinations may be made to the exemplary embodiment described above without departing from the spirit of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming device configured to form an image on a sheet using a rotating body under a predetermined image forming condition;

at least one processor configured to implement:

a corrector configured to correct the image forming condition to adjust image density unevenness corresponding to a rotation cycle of the rotating body; and a controller configured to control the image forming device to form on at least one sheet (i) a plurality of test images that are different in correction amount for the image forming condition and (ii) pointing images indicating intervals corresponding to the rotation cycle of the rotating body, in a state where the rotating body is continuously rotated, wherein the controller is configured to determine the intervals corresponding to the rotation cycle of the rotating body using a signal related to a gap between the rotating body and another body.

2. The image forming apparatus according to claim 1, wherein the controller is configured to obtain the rotation cycle of the rotating body using a signal corresponding to a surface shape of the rotating body.

3. The image forming apparatus according to claim 2, wherein the another body is an image carrier, wherein the rotating body is a developing body configured to develop an electrostatic latent image carried by the image carrier, and wherein the controller is configured to obtain the rotation cycle of the developing body using the signal related to the gap between the developing body and the image carrier.

4. The image forming apparatus according to claim 3, wherein the corrector is configured to correct a magnitude of a voltage to be applied to the developing body, and wherein the controller is configured to obtain the rotation cycle of the developing body using an alternating current that flows between the developing body and the image carrier in accordance with the voltage applied to the developing body.

5. The image forming apparatus according to claim 1, wherein the controller is configured to control the image forming device to form the plurality of test images which are different in correction amount, on a plurality of different sheets.

6. The image forming apparatus according to claim 1, wherein the controller is configured to control the image forming device to form at least one of the pointing images in each of the test images which are different in correction amount.

7. The image forming apparatus according to claim 6, wherein the controller is configured to control the image forming device to form the pointing images in the test images so as to overlap.

8. The image forming apparatus according to claim 1, wherein the rotating body is a developing body, and wherein the another body is an image carrier.

9. The image forming apparatus according to claim 1, wherein the signal is related to an alternating current flowing between the rotating body and the another body.

10. A non-transitory computer readable medium storing a program that, if executed, causes a computer to execute image formation processing, the image forming processing comprising:

determining a correction amount for an image forming condition to adjust image density unevenness corresponding to a rotation cycle of a rotating body, an image forming device being configured to form an image using the rotating body under the image forming condition;

controlling the image forming device to form on at least one sheet (i) a plurality of test images that are different in correction amount for the image forming condition and (ii) pointing images indicating intervals corresponding to the rotation cycle of the rotating body, in a state where the rotating body is continuously rotated; and determining the intervals corresponding to the rotation cycle of the rotating body using a signal related to a gap between the rotating body and another body.

11. An image forming apparatus comprising:

an image forming means for forming an image on a sheet using a rotating body under a predetermined image forming condition;

a correction means for correcting the image forming condition to adjust image density unevenness corresponding to a rotation cycle of the rotating body; and a control means for controlling the image forming means to form on at least one sheet (i) a plurality of test images that are different in correction amount for the image forming condition and (ii) pointing images indicating intervals corresponding to the rotation cycle of the rotating body, in a state where the rotating body is continuously rotated, wherein the control means determines the intervals corresponding to the rotation cycle of the rotating body using a signal related to a gap between the rotating body and another body.

12. An image forming apparatus comprising:

at least one processor configured to implement:

a corrector configured to correct image density unevenness corresponding to a rotation cycle of a rotating body of an image forming device; and a controller configured to control the image forming device to form on at least one sheet (i) a plurality of test images that are different in correction amount and (ii) pointing images indicating intervals corresponding to the rotation cycle of the rotating body when the rotating body is continuously rotated, wherein the controller is configured to determine the intervals corresponding to the rotation cycle of the rotating body using a signal related to a gap between the rotating body and another body.

* * * * *